United States Patent [19]

Corrigan

[11] Patent Number: 4,554,621

[45] Date of Patent: Nov. 19, 1985

[54] MODULAR LIGHT ASSEMBLY

[75] Inventor: John J. Corrigan, Washington, Conn.

[73] Assignee: Anton/Bauer, Inc., Shelton, Conn.

[21] Appl. No.: 665,939

[22] Filed: Oct. 29, 1984

[51] Int. Cl.[4] ..... H01R 33/00

[52] U.S. Cl. ..... 362/382; 362/226; 362/3; 362/8; 362/199

[58] Field of Search ..... 362/382, 3, 8, 7, 226, 362/194, 199, 80, 393, 433

[56] References Cited

U.S. PATENT DOCUMENTS

| | | | |
|---|---|---|---|
| 3,333,519 | 8/1967 | Padelt | 362/8 |
| 3,527,437 | 9/1970 | Lippman | 362/8 |
| 3,601,595 | 8/1971 | Kivela | 362/199 |
| 3,999,055 | 12/1976 | Wakahara et al. | 362/3 |
| 4,051,493 | 9/1977 | Nakagawa et al. | 362/3 |
| 4,129,899 | 12/1978 | Dunbar | 362/199 |
| 4,219,870 | 8/1980 | Haradon et al. | 362/226 |
| 4,300,188 | 11/1981 | Addario | 362/226 |
| 4,376,967 | 3/1983 | Hough | 362/226 |
| 4,388,679 | 6/1943 | Blaisdell et al. | 362/3 |

*Primary Examiner*—Raymond A. Nelli

*Attorney, Agent, or Firm*—Kramer and Brufsky

[57] ABSTRACT

Cube-shaped, ventilated, individual light modules housing a lamp or bulb having different predetermined characteristics are interchangeably mounted on an expandable clip surrounding an electrical socket, by sliding the module down on the clip and simultaneously establishing electrical contact between the bulb in the module and a power source and switch. The front of the module is faced with safety glass to protect the bulb and subject, and a space is provided between the module and protective safety glass which can be fitted with one or more, swing-away, wide angle adapter, diffuser, or dichroic lenses.

15 Claims, 10 Drawing Figures

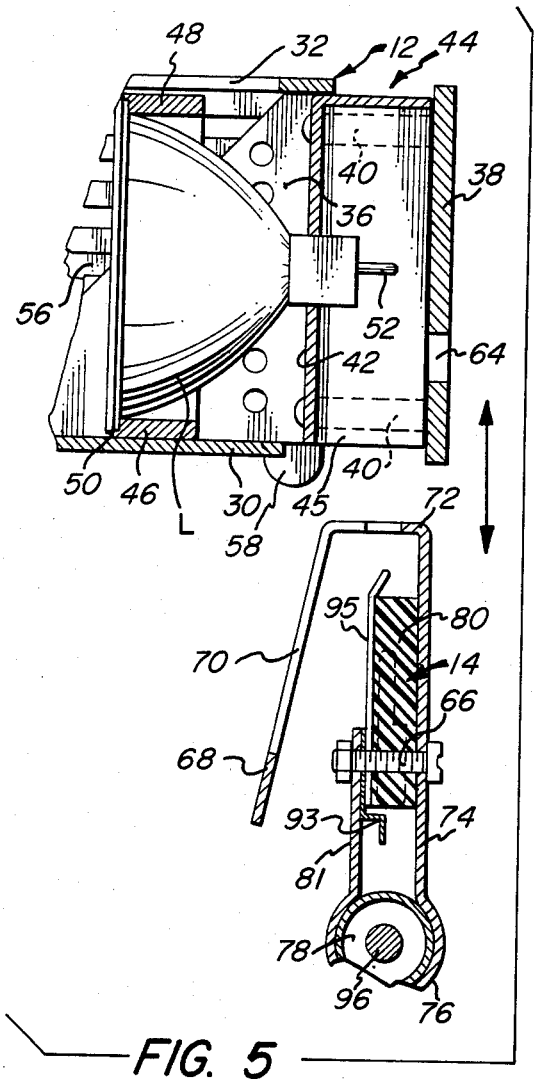
FIG. 5
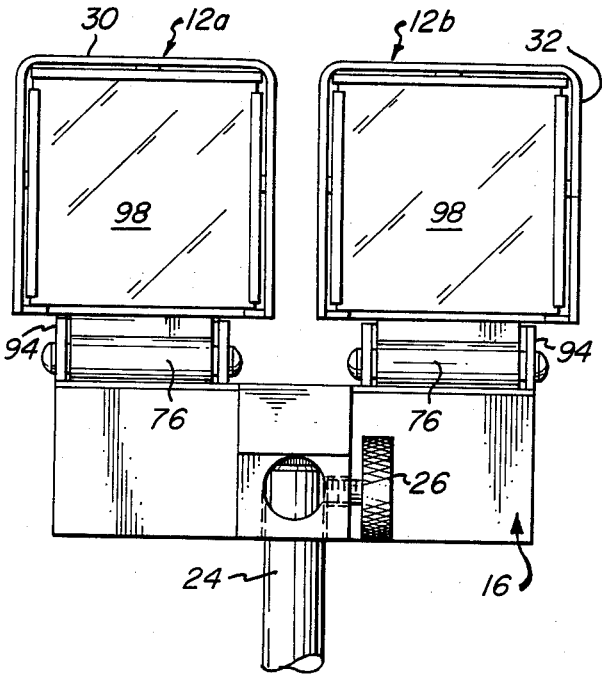
FIG. 10
FIG. 6
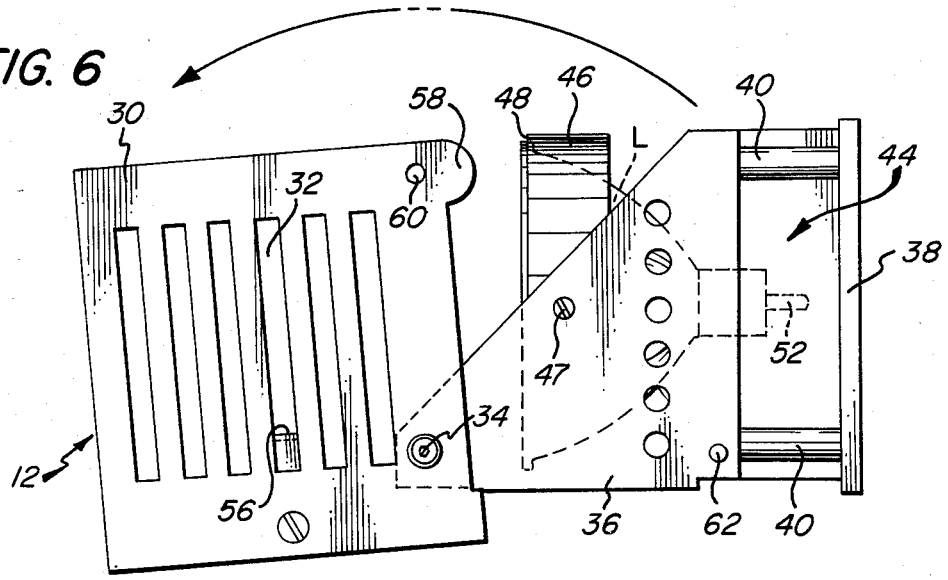

MODULAR LIGHT ASSEMBLY

FIELD OF THE INVENTION

This invention relates to a light construction, and more particularly, a modular light construction enabling interchangeable lamp housings to be quickly mounted on and disconnected from a lamp base which can be mounted on a portable camera, such as a video or film camera where lighting effects and requirements are continuously subject to change, or alternatively, enabling the mounting of the lamp housing on a light stand.

DESCRIPTION OF THE PRIOR ART

At present there are a variety of portable lights that can be mounted on a video or film camera or mounted on a light stand. As lighting requirements vary with each situation, it becomes necessary to change the bulb in these lights to match the specific requirements. For example, the wattage (power) may be tailored to the application by choosing a low wattage bulb where minimum illumination is required thus conserving power consumption as well as more precisely fulfilling the visual requirements. Conversely, a high wattage bulb can be employed when additional light is needed. Similarly, a low voltage (12–14 v) bulb can be used for battery operation whereas a 115 volt bulb can be used when such power is available. In such cases where the bulb must be changed or replaced, it is necessary to physically handle the bulb itself in order to remove it from the light. This presents several problems:

(1) The bulb can be extremely hot which may cause injury to the user. The heat makes the bulb difficult to handle and can result in the expensive bulb being dropped and broken. In many cases the operator must wait until the bulb cools wasting valuable production time or missing a documentary type event that cannot be recreated;

(2) Handling of these quartz bulbs in the field is undesirable as fingerprints on the bulb can etch the surface and reduce bulb life;

(3) These expensive quartz bulbs are very fragile and can easily be broken in the process of relamping a light in the field;

(4) These quartz bulbs have very delicate electrical contacts comprised of two narrow diameter pins held in place by the extremely brittle quartz envelope. In practice it is very easy to damage or destroy a bulb breaking or bending these pins during the relamping process;

(5) Spare bulbs are usually carried in the field within the cardboard boxes supplied with the bulbs by the bulb manufacturers. These boxes offer severely inadequate protection for these delicate bulbs under typical field conditions; thus spare and alternate bulbs are often damaged or destroyed before they are even used;

(6) Because of the above and the overall delicate nature of the relamping process, many operators decide not to change bulbs even though it would be visually desirable to do so; and (7) If relamping does take place, it is time consuming for the aforementioned reasons. In addition, the new bulb must be taken from a storage container and installed in the light while the old bulb must be removed from the light and safely placed within a storage container.

This invention remedies the deficiencies noted with regard to prior art light assemblies mounted on video cameras and the like by providing a modular construction whaerein lamps or bulbs housed within individual lamp modules can be quickly removed and replaced with a different module having a desired lighting characteristic. The use of a separate lamp module precludes the necessity of the operator directly handling the lamp or bulb, and thus enables the lamp or bulb to be quickly replaced with a minimum effort and time. Furthermore, the interchangeable lamp module which houses the bulb acts as a sturdy protective field storage case when the bulb is not being used. Moreover, bulb replacement within the lamp module does not involve the electrical contacts; thus the delicate coontact pins cannot be damaged when the operator originally replaces the bulb within the lamp module. Safe electrical contact is facilitated automatically when the lamp module is placed onto the base assembly.

SUMMARY OF THE INVENTION

In accordance with the invention, a substantially cube-shaped, ventilated, light module housing a lamp or bulb having desired predetermined characteristics has a pocket which is slidably received over a spring metal, expandable clip surrounding an electrical socket. Upon sliding of the module down on the clip, the clip is compressed and the contact pins of a lamp or bulb housed within the module are placed into electrical contact with a pair of contacts positioned in the socket housing so that upon the actuation of a switch on a base member mounting the clip and socket, the bulb can be illuminated. The rear surface or backplate of the module enclosing the pocket of the module is provided with a hole. The module being biased by contact with the clip, receives the head of a detent screwhead on a fastener mounting the socket to the clip, which snaps into the hole in the backplate of the module to lock the module to the clip. Upon rocking the module slightly backward, the clip is compressed enabling the back plate to pull free or clear the detent permitting the module to be removed by sliding it upwardly from the socket housing along the clip. The light module which is removed can then be replaced with another module housing a bulb or lamp with different characteristics, as desired.

The socket and resilient clip are pivotably connected to the top of the base member which mounts the switch and houses the electrical wiring for the lamp assembly. Once the module is connected to the socket, the socket and clip can be pivoted or tilted on the base for direct and indirect lighting applications, as required. The base is removably mounted to a pedestal or post on the camera, or to a light stand.

The light module housing is also provided with a ventilated hood portion which can be rotated away from the backplate to expose the lamp or bulb housed within the module so that the bulb itself can be removed and replaced, if damaged. The front of the module is faced with safety glass to protect the bulb, subject and user and a space is provided between the hood of the module and protective safety glass which can be fitted with one or more, swing-away, wide angle adapter, diffuser, or dichroic lenses.

BRIEF DESCRIPTION OF THE DRAWINGS

Further objects and advantages of the invention will become apparent from the following description and claims, and from the accompanying drawings, wherein:

FIG. 1 is a perspective view of the modular light assembly of the present invention mounted on a video camera or the like;

FIG. 5 is an exploded, partial longitudinal cross-sectional view of the light module and clip and socket subassembly of the modular light assembly of the present invention, illustrating the manner in which the light module can be attached to and removed from the upright clip and socket subassembly;

FIG. 6 is a side view in elevation of the light head module of the modular light assembly of the present invention with a vented hood of the module pivoted away from the module backplate to expose the lamp within the module so it can be removed and replaced;

FIG. 10 is a front view in elevation of an alternate form of the modular light assembly of the present invention simultaneously mounting a pair of alternately used light modules on a single base member.

DETAILED DESCRIPTION OF THE PREFERRED EMBODIMENT

Figure 1:
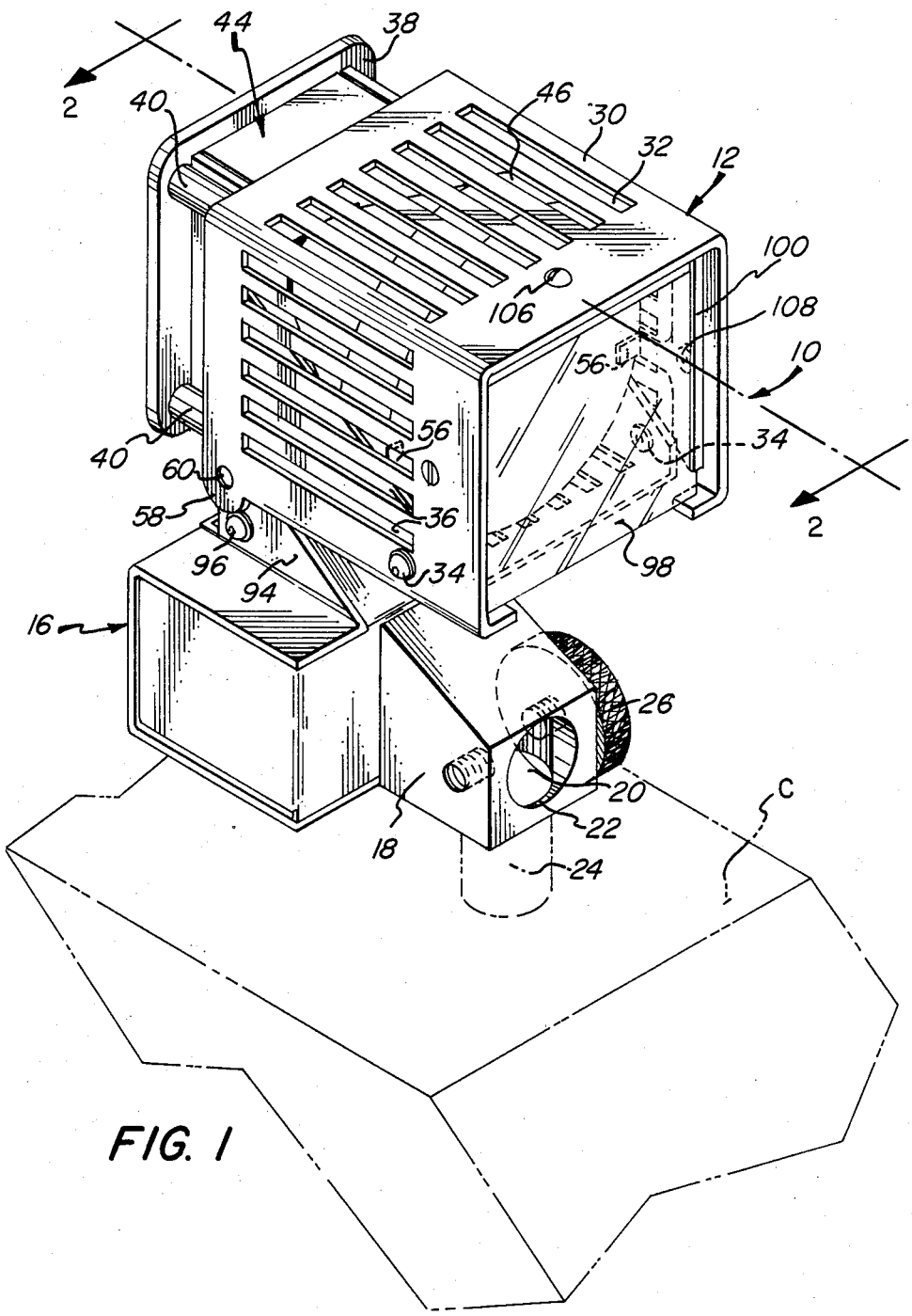

Referring now to the drawings in detail, wherein like numerals indicate like elements throughout the several views, the modular light assembly of the present invention is illustrated generally in FIG. 1 by the numeral 10.

The modular light assembly 10 includes a light module 12 adapted to be slidably received and removable from a substantially upright clip and socket subassembly 14. The clip and socket subassembly 14 is pivotably mounted on a substantially rectangular parallelopiped base member 16 provided with an extension 18 having a pair of perpendicular circular openings 20 and 22 adapted to receive a mounting post 24 on a video camera C, light stand, or the like. Upon insertion of the post 24 within one of the openings 20, 22, a thumbscrew 26 can be rotated to mount the light assembly 10 on the camera C.

The light module 12 includes a ventilated hood 30 which is substantially in the shape of a cube provided with a plurality of rectangular vents or slots 32 so that heat from a bulb or lamp L housed within the module can be dissipated to the ambient surroundings. The hood 30 is pivoted by bushings 34 or the like to the outer surface of a pair of parallel, triangular sideplates 36 projecting forwardly from a backplate 38. The backplate 38 is threadedly connected in spaced relation by suitable fasteners disposed within cylindrical housings 40 to a rearplate 42 bridging the space between the forwardly projecting parallel sideplates 36. Housings 40 space the backplate 38 and rearplate 42 from each other in parallel relation. This space is enclosed on three sides to form a pocket 45. The space is enclosed by a housing 44 consisting of three plates projecting rearwardly from the rearplate 42 towards backplate 38 which form an access opening to the pocket 45 between the lower edges of the rearplate 42 and backplate 38.

Mounted between the triangular sideplates 36 is a ring 46 having an annular rim 48 adapted to contact in mating engagement the annular rim 50 on a lamp or bulb L adapted to be disposed within the light module 12. The bulb or lamp L includes a rearwardly extending housing provided with a pair of parallel contact pins 52 extending rearwardly therefrom. When the rim 50 of the lamp L is seated in contact with the annular rim 48 of ring 46 provided between the sideplates 36, the rearwardly projecting housing extends through a substantially rectangular opening 54 formed in the rearplate 42. When the hood 30 is pivoted from an open position relative to the triangular sideplates 36 as illustrated in FIG. 6, to a closed position as illustrated in FIGS. 1, 2, and 5, an L-shaped leg 56 mounted on each side of the hood projects from both sides of the hood 30 across a portion of the face of the bulb L adjacent its rim 50 to hold the bulb within the ring 46.

The hood 30 includes a pair of downwardly extending semi-circular ears 58 provided with an opening 60 therethrough which is adapted to receive a snap detent 62 adjacent the juncture of the legs of each triangular sideplate 36 when the hood is pivoted to a closed position so that the hood is retained in its closed position. In order to open the hood 30, each of the ears 58 can be grasped and pulled away from the detent 62 until the detents clear and are removed from the opening 60 enabling the hood to be pivoted to its open position as shown in FIG. 6 wherein access to the lamp or bulb L can be had to mount or replace the same. The backplate 38 is also provided with a substantially circular opening 64 for engagement with the head of a fastener 66 as will be described hereinbelow.

Figure 2:
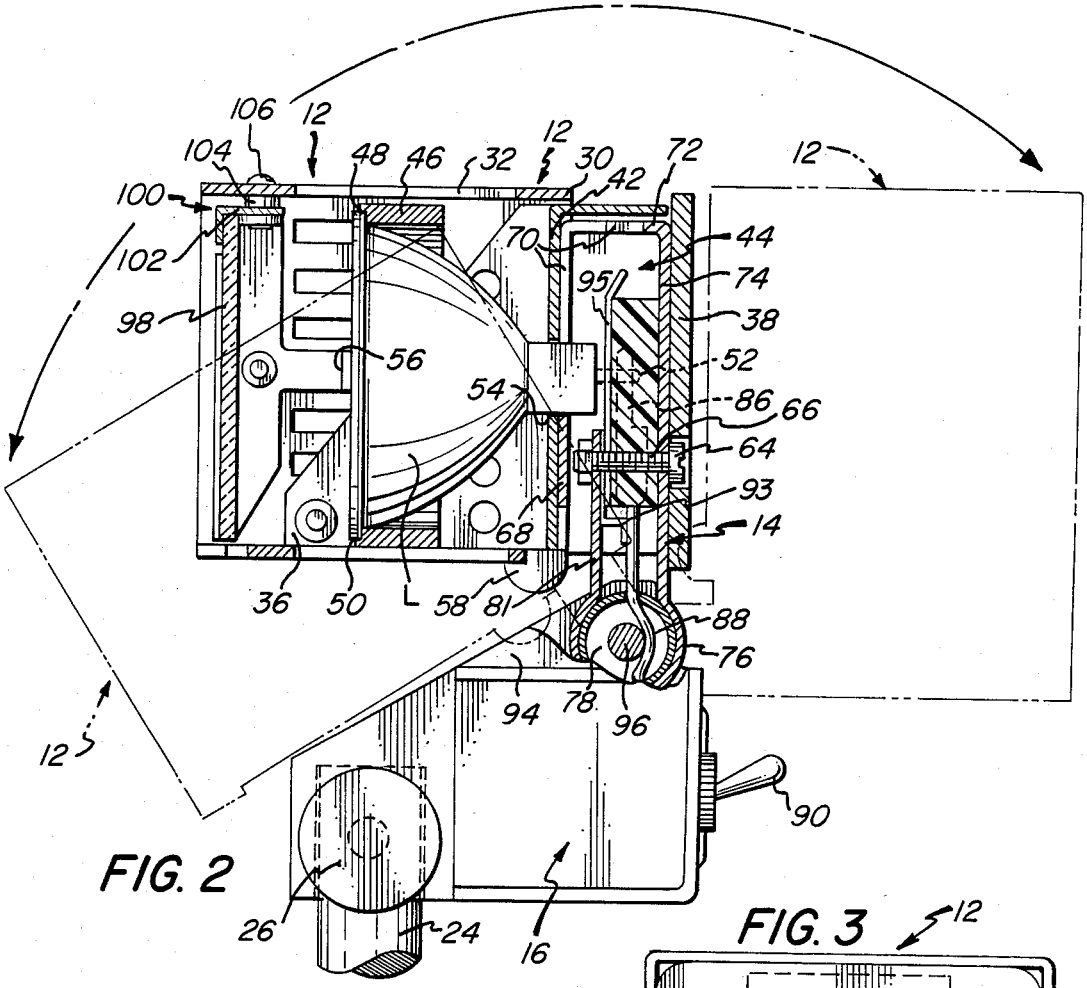
FIG. 2 is a longitudinal cross-section through the modular light assembly of FIG. 1 taken substantially along the plane indicated by line 2—2 of FIG. 1, and illustrating in phantom lines, the manner in which the light head module can be tilted or swivelled for indirect lighting of a subject.
Figure 4:
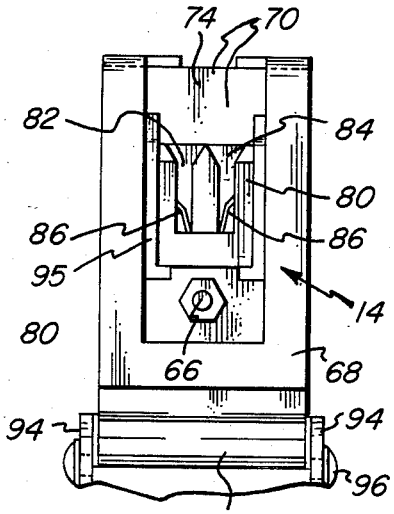
FIG. 4 is a front view in elevation of a resilient clip and socket subassembly which receives a light module in the modular light assembly of FIGS. 1 and 2.
Figure 3:
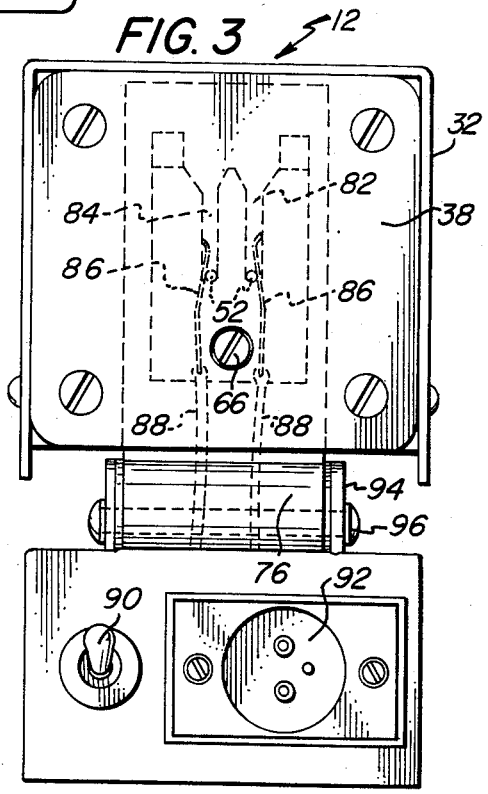
FIG. 3 is a rear view in elevation of the modular light assembly of FIG. 2.

As shown more clearly in FIGS. 2, 4, and 5, the clip and socket subassembly 14 is formed from a clip of resilient metal having a front rectangular plate or leg portion 68 provided with a rectangular cut-out 70, a top plate or leg portion 72 which forms an obtuse angle with front plate 68 and contains an extension of cut-out 70, and a rear plate portion or leg 74 which is bent into a substantially circular bottom portion 76 and resiliently clamped about a shoulder washer or roller 78. The clip terminates in an upright plate or leg portion 81 somewhat shorter than, but parallel to, the rear leg 74. Threaded fastener 66 secures a dielectric socket housing member 80 between the parallel legs 74 and 81 of the clip.

The dielectric socket housing member 80 includes a pair of parallel slots 82 and 84 adapted to receive the parallel coontact pins 52 extending from the rear of lamp or bulb L until contact is made with a pair of spring, electrically conductive contact elements 86 provided in each of the parallel slots 82, 84. The contact elements 86 are each connected by a suitable electric wire 88 to a manually-operated switch 90 located on the rear of base member 16. Switch 90 is connected in electrical series with wires 88, contact elements 86, pins 52 and a power source connected via a cable to a terminal 92 provided on the rear of base member 16. The circuit is safety grounded through a metal plate 93 fixed to metal U-shaped bracket 95 on the front of dielectric socket member 80 by screw fastener 66. The shoulder washers 78 are rotatably mounted between a pair of upright ears 94 on base 16 by a threaded shaft 96 extending therethrough.

The front of the hood 30 is closed by a rectangular or square piece of tempered safety glass 98 extending downwardly from an L-shaped holder or frame 100 surrounding the glass on three sides along its top and two parallel side edges. Each of the sides of the frame 100 is provided with a rearwardly projecting leg 102 which receives a threaded fastener 106 therethrough from the exterior of the hood 30 adjacent the rear surface of the glass 98. A washer 104 is provided on each fastener 106 between the interior surface of hood 30 and the exterior surface of frame 100 to space the frame from the hood along three sides. A nut 108 comprising a permanent part of frame 100 is provided on each fastener 106 on the interior surfaces of frame 100. The safety glass 98 is permanently held in place on frame 100 in front of the bulb or lamp L by abutment of the nuts 108 with the rear surface of safety glass 98.

Figure 7:
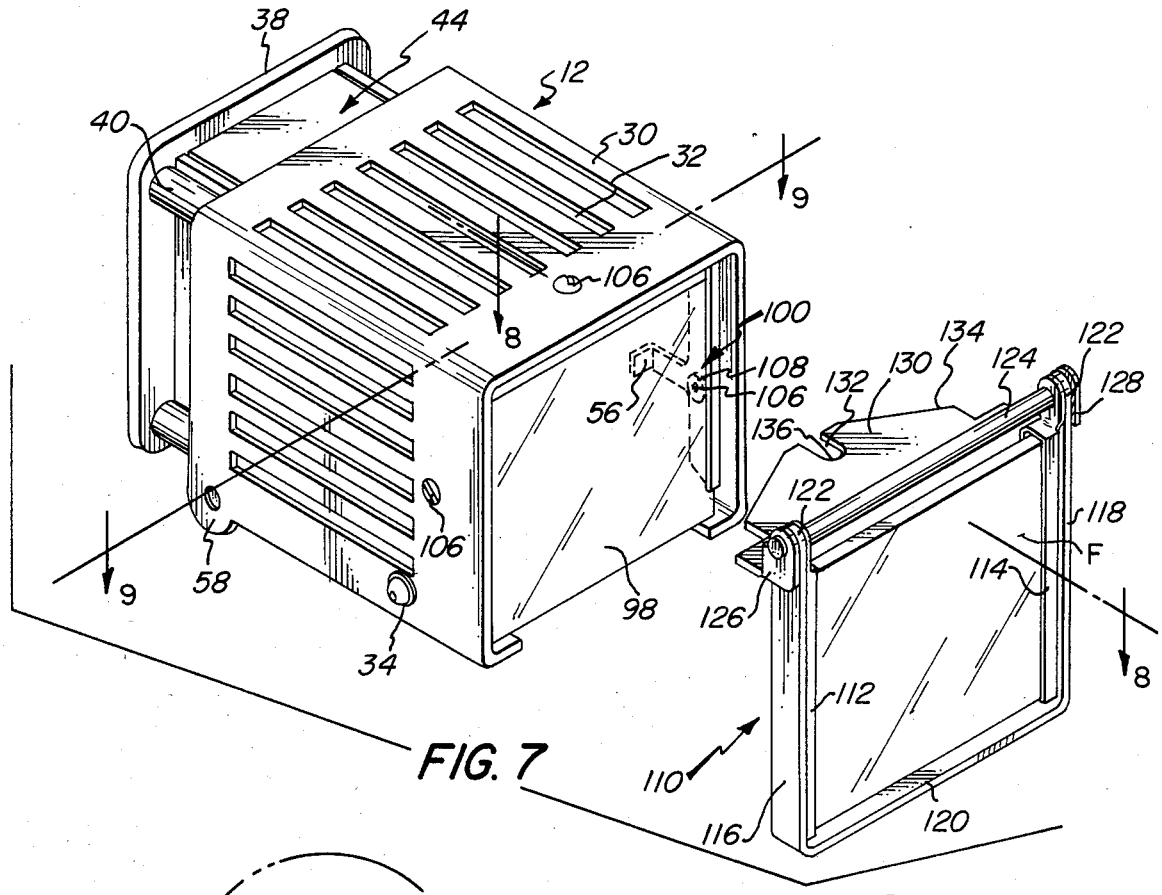
FIG. 7 is an exploded perspective view of the light module used in the assembly of the present invention about to be fitted with an auxiliary, swivel-type filter.
Figure 8:
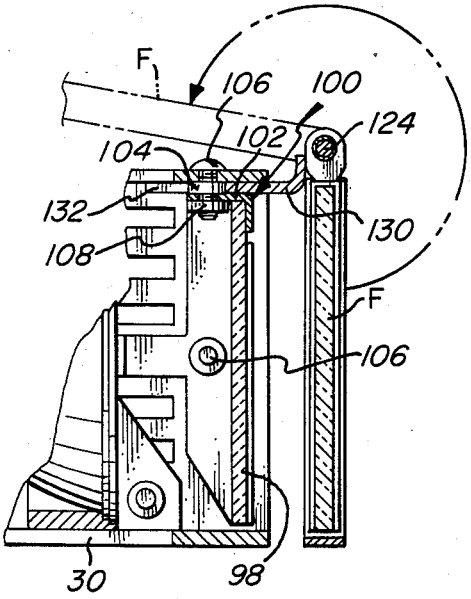
FIG. 8 is a partial cross-sectional view of the assembled module and filter of FIG. 7 taken substantially along the plane indicated by line 8—8 of FIG. 7, with the filter being pivoted to a stored, non-use position illustrated in phantom lines.
Figure 9:
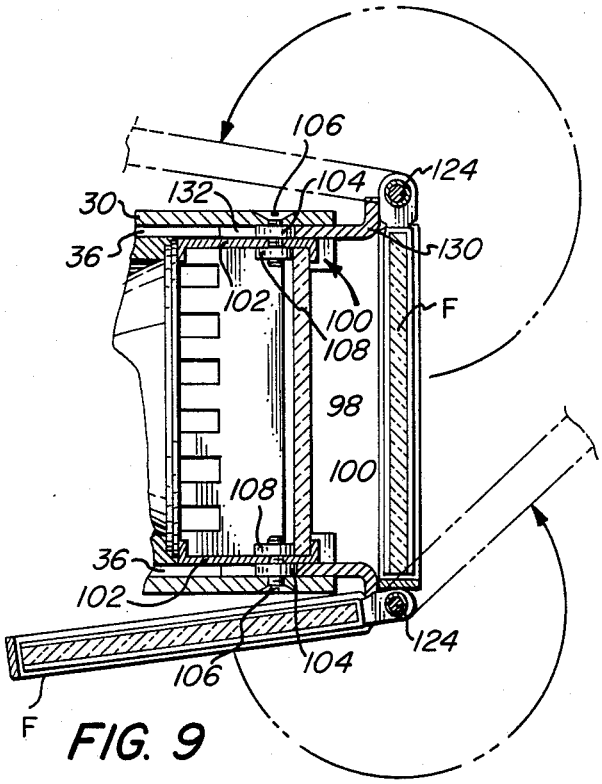
FIG. 9 is a partial cross-sectional view of the module and a pair of swivel-type filters illustrated in FIG. 7 in an alternate mode on the side of the module hood and showing in phantom lines, the manner of use and the manner of storing the filters when not in use.

In certain instances, it may be desairable to supply the module 12 with a wide angle lens, diffuser lens, or dichroic lens, generally indicated by the letter F in FIGS. 7 to 9 inclusive. The lens F is mounted in a substantially U-shaped frame 110 provided with spaced guides 112, 114 on the opposed legs 116, 118 connected to the base 120 of frame 110. A pair of ears or tabs 122 extend upwardly from the end of each leg 116, 118 of frame 110 and rotatably mount a shaft 124 therebetween. Mounted for relative rotation on opposite ends of shaft 124 are a pair of ears 126, 128 having a rearwardly extending L-shaped plate 130 connected therebetween along its shorter leg and provided with slot 132 opening in the rear edge 134 of plate 130 which includes an inner substantially semi-circular portion 136 whose diameter approximates the diameter of each of the washers 104.

The lens F is easily mounted on the front of module 12 by sliding slot 132 over washer 104 into frictional engagement with the washer which is lodged in semicircular portion 136 of slot 132. The horizontal portion of plate 130 occupies the space between the bottom surface of hood 30 and the top of frame 100 as shown in FIG. 8. The lens F can be pivoted about shaft 124, as shown in phantom lines in FIG. 8, when not needed, and it will lie adjacent the top of the hood 30. Alternatively, a lens F can be attached to one or each of the washers 104 along the sidewalls of hood 30, as shown in FIG. 9. The side-attached lenses F can alternately be swung about their respective shafts 124 in front of the lamp or bulb L and safety glass 98, as indicated in phantom in FIG. 9. The lens F can be mounted directly in abutment with hood 30 between frame 100 by the elimination of washers 104, if a permanent installation is desired.

In use, the light module 12 with or without one or more of the lenses F attached to a washer 104, can be quickly exchanged with another and mounted on the clip and socket subassembly 14 with the pins 52 of the bulb or lamp L in that module placed in electrical contact with the contact elements 86 in the socket housing member 80 by simply liding the pocket 45 under housing 44 formed between the backplate 38 and rearplate 42 over the clip legs 68 and 74 causing the legs 68 and 74 to be resiliently bent towards each other wherein they will expand within the pocket 45 and tightly hold the module 12 on the clip and socket subassembly 14. In order to aid in locking the module 12 to the subassembly 14, the head of fastener 66 will serve as a detent and snap within opening 64 as the housing 44 is slid over the clip legs 68 and 74 as shown in FIG. 2. In order to remove the light module 12, it is only necessary to rock the module 12 slightly backward until the backplate 38 pulls free of the detent head of screw 66 and raise the backplate upwardly and away from the clip and socket subassembly 14. Thus, the bulb or lamp L can be replaced quickly without ever touching the lamp by replacing the light module with another light module containing the desired bulb. When the housing 44 is slid over the resilient legs 68, 70, the pins 52 projecting rearwardly from the lamp L will slide through the slot 70 in the front and top leg portions 68 and 72 of the clip into the parallel slots 82, 84 in the socket housing member 80 until they are placed in contact with the contact elements 86 electrically connected in series with switch 90 and a power source connected to cable plug 92.

As shown in phantom lines in FIG. 2, the light module 12 can be pivoted or tilted in a forward or rearward direction along with the clip and socket subassembly 14 about shaft 96 connecting shoulder washer 78 to the upright ears 94, so that rather than direct lighting, indirect lighting can be provided on the subject illuminated for viewing by the camera C.

If desired, the hood portion 30 of module 12 can be pivoted about bushings 34 away from backwall 38 about the sidewall plates 36 as shown in FIG. 6 to provide access to the bulb or lamp L so it can be removed from the ring 48 and replaced if necessary.

By unthreading the thumbscrew 26, the entire light assembly 10 can be removed and remounted, if desired on an upright standard for use separate from the camera C. It should also be understood that while the foregoing discussion has illustrated use of the light assembly 10 of the invention in conjunction with a video camera, it can be used as well with film cameras, light stands or the like.

Similarly, as shown in FIG. 7, a pair of modules **12*a* and 12*b* identical in all respects to module 12, can be mounted on a single base member 16 with a single power input and controlled by a pair of switches which are placed in parallel with the power source so that the lamps L in each module 12*a*, 12*b*** can be switched on at will, alternatively, or simultaneously.

What is claimed is:

1. A modular light assembly comprising:

a base member, at least one electrical socket means pivotably mounted on said base member, a light module having a housing adapted to mount a lamp, said housing including a pair of sideplates and a hood pivotably mounted to said sideplates and pivotable from a first position forming an enclosure with said sideplates to a second position permitting access to the interior of said enclosure for removing and replacing a lamp mounted therein, means for securing said module onto said electrical socket means, and means between said electrical socket means and module for releasably retaining said module on said electrical socket means, with the lamp in said module in electrical contact with said electrical socket means, and means on said base member for securing said base member to a support, said means including a pocket on the module slidably received on the electrical socket means.

2. The light assembly of claim 1 wherein said pocket received on said electrical socket means is formed by a rearplate extending between said sideplates and a backplate spaced from said rearplate.

3. The modular light assembly construction of claim 2 wherein said rearplate includes an opening therein adapted to receive a portion of a lamp mounted in said module enclosure and extending into said pocket.

4. The light assembly of claim 3 wherein said electrical socket means is substantially upright and includes a resilient clip construction having a pair of legs connected by a top wall, one of said legs being at an obtuse angle with respect to said top wall, said legs being received in said pocket between said rearplate and backplate on said light module.

5. The light assembly of claim 4 wherein said resilient clip construction includes a cut-out in one of said legs adjacent the rearplate of said module and the top wall connecting said legs adapted to receive in sliding engagement the electrical contact portion of said lamp mounted within said light module enclosure extending into said pocket.

6. The light assembly of claim 5 wherein said electrical socket means includes a dielectric block disposed between said legs of said clip which includes a pair of slots adapted to receive the portion of said lamp extending into said cut-out and means within said slots for forming an electrical connection to said lamp portion extending into said cut-out.

7. The light assembly of claim 6 including electrical switch means on said base member electrically connected to said electrical connections in said dielectric block of said socket means.

8. The light assembly of claim 7 including a third leg on said clip construction between said first and second legs, means between said second and third legs for securing said dielectric block therebetween, and an arcuate portion connecting said second and third parallel legs secured to shoulder washers pivotably mounted on said base member.

9. The light assembly of claim 8 including an opening in said backplate of said module, and the means between said second and third legs for securing said dielectric block therebetween having a detent head adapted to be received in said opening in said backplate to lock said electrical socket means to said module backplate.

10. The light assembly of claim 9 including a safety visor permanently mounted on the front of the hood of said module.

11. The light assembly of claim 10 wherein said safety visor is spaced from at least one interior surface of said hood, and a removable lens is pivotably mounted on said hood in said space in fromt of said safety visor.

12. The light assembly of claim 11 wherein said visor is spaced from the interior surface of said hood by a washer, and said removable lens includes a frame, and a mounting plate pivotably connected to said frame including a slot opening along one edge thereof adapted to be disposed about said washer, the sidewalls defining said slot being frictionally engaged on said washer.

13. The light assembly of claim 1 including a safety visor permanently mounted on the front of the hood of said module.

14. The light assembly of claim 13 wherein said safety visor is spaced from at least one interior surface of said hood, and a removable lens is pivotably mounted on said hood in said space in front of said safety visor.

15. The light assembly of claim 14 wherein said visor is spaced from the interior surface of said hood by a washer, and said removable lens includes a frame, and a mounting plate pivotably connected to said frame including a slot opening along one edge thereof adapted to be disposed about said washer, the sidewalls defining said slot being frictionally engaged on said washer.

* * * * *